United States Patent [19]

Ishii

[11] Patent Number: 4,823,119

[45] Date of Patent: Apr. 18, 1989

[54] PATTERN WRITE CONTROL CIRCUIT

[75] Inventor: Takatoshi Ishii, Tokyo, Japan

[73] Assignee: Tokyo Shibaura Denki Kabushiki Kaisha, Kawasaki, Japan

[21] Appl. No.: 858,553

[22] Filed: Apr. 24, 1986

Related U.S. Application Data

[63] Continuation of Ser. No. 563,442, Dec. 20, 1983, abandoned.

[30] Foreign Application Priority Data

Dec. 22, 1982 [JP] Japan ..... 57-225201
Dec. 22, 1982 [JP] Japan ..... 57-225202
Feb. 2, 1983 [JP] Japan ..... 58-15941

[51] Int. Cl.[4] ..... G09G 1/28

[52] U.S. Cl. ..... 340/703; 340/701; 340/744; 340/798

[58] Field of Search ..... 340/701, 703, 744, 747, 340/748, 750, 789, 798, 799, 803; 365/49

[56] References Cited

U.S. PATENT DOCUMENTS 4,016,544 4/1977 Morita et al. ..... 340/747
4,475,161 10/1984 Stock ..... 340/701
4,491,836 1/1985 Collmeyer et al. ..... 340/750

FOREIGN PATENT DOCUMENTS 0105724 9/1983 European Pat. Off. ..... 340/701
56-63965 4/1983 Japan .

*Primary Examiner*—Gerald L. Brigance
*Assistant Examiner*—Jeffery A. Brier
*Attorney, Agent, or Firm*—Cushman, Darby & Cushman

[57] ABSTRACT

A pattern write control circuit of the invention has a graphic memory consisting of a plurality of memory planes each storing corresponding to color data for color display, an address selector for supplying a common address to the plane memories, a register storing the color data corresponding to each memory plane and simultaneously supplying the color data to a common location of the memory planes accessed by the common address, and a decoder for producing write enable signal for writing the color data into a specified memory plane in accordance with the display color data of the dot supplied from a CPU.

16 Claims, 13 Drawing Sheets

PATTERN WRITE CONTROL CIRCUIT

This is a continuation of application Ser. No. 563,442, filed Dec. 20, 1983, which was abandoned upon filing hereof.

BACKGROUND OF THE INVENTION

The present invention relates to a pattern write control circuit for use in a display device having a color graphic display function. A conventional CRT display unit having a graphic display function includes a video RAM wherein data for turning on or off a dot on display coordinates is stored in a one-bit location of a memory cell. These memory cells are arranged to consist of a word, so that data read/write operation is performed on a word basis. Data write in such a video RAM generally requires various control operations of read, modification and write. More specifically, when a point of certain coordinates on a screen is to be turned on or off, the following sequence is followed (i) the memory address of the dot is calculated. (ii) The content at the calculated address is read out (in units of words). (iii) Among the read-out data of one-word, the bit corresponding to the coordinates is modified for turning on or off the dot. (iv) The bit-modified data of one word is written in the address from which the original data has been read out. Without the above operation, turning on or off the dot of the coordinates will change the surrounding dots of the coordinates.

In this manner, since various control operations of read, modification and write are conventionally involved in data write of a video RAM, the control procedures become complex. This increases the software load and requires a long period of time for data write. High performance of display systems of the type as described above has therefore been difficult to achieve. In a color graphic display device having a color display function, a video RAM must have a plurality of planes. For example, in the case of a 16-color display, four planes must be provided. Then, the above-mentioned control operations of one-word read, bit modification and one-word write must be performed for each of the four planes, further complicating the write procedures. In a conventional color graphic display device, when a graphic memory comprises four planes each plane having 16 kB (kilobyte) capacity, the CPU must have an address space of 16 kB$\times$4=64 kB for accessing the graphic memory. This results in a long address calculation time for each plane.

Thus, a conventional color graphic display device requires a long time for pattern write, which prevents an improvement in system performance.

In order to allow color display in a larger number of colors, a color graphic display device having a tiling function has been proposed. A color graphic display device of higher class must provide a display in a larger number of colors. However, a conventional color graphic display device includes a video RAM which comprises three to four stages of memories each storing color data. For example, it can display a maximum of only 16 colors simultaneously with four stages of memories. According to the tiling function, a required portion is displayed solid with adjacent dots being displayed in different colors. Since the actual dots are considerably small, dots displayed in different colors appear in a mixed color at a distance from the screen. This function is called tiling since the procedure of writing dots of different colors resembles alternate fitting of tiles having different colors. Tiling is generally performed between two adjacent dots. This is because tiling in a range encompassing more than two dots degrades the obtained color shading and increases the software load for write control. By the tiling function of two adjacent dots on a display screen, an equivalent of three types of luminance for each color element can be achieved in three ways; the color element is lighted on both of two adjacent dots, it is lighted on either one dot of the two adjacent dots, and it is lighted on neither of them. Therefore, if a video RAM comprises three planes each having different color element data, $3^3=27$ different colors are equivalently obtained. If a video RAM comprises four planes, $3^4=81$ different colors are equivalently obtained. This requires a complex procedure when it is performed by software using known hardware. This is because the color must be changed for each dot and the task for performing this is designated in units of dots. Therefore, synthesis of data in the video RAM a screen before write operation of a dot and dot data to be written must be performed in a main memory. For this reason, when the conventional graphic display device is to incorporate a tiling function, a load on software is too great and processing speed is impaired.

SUMMARY OF THE INVENTION

It is an object of the present invention to provide a pattern write control circuit which allows high-speed pattern write in a video RAM for a color graphic display device.

It is another object of the present invention to provide a pattern write control circuit which allows high-speed tiling write in a video RAM for a color graphic display device.

In order to achieve the above object of the present invention, there is provided a pattern write control circuit comprising: memory means which has a plurality of memory planes each having an address data input terminal and a color element data input terminal and in which items of color element data are bits of a word designated by an address data supplied to the address data input terminals of the memory planes, said items of color element data being assigned to the memory planes, respectively, and used to display a color dot; address data supply means for supplying common address data to said address data input terminals of said memory planes, to thereby write pattern data in the memory planes; and color element data supply means for simultaneously supplying the items of color element data to the color element data input terminals of said memory planes.

BRIEF DESCRIPTION OF THE DRAWINGS

These objects and features of the present invention will be apparent from the following descriptions of the accompanying drawings summarized below.

DETAILED DESCRIPTION OF THE PREFERRED EMBODIMENTS

Figure 1:
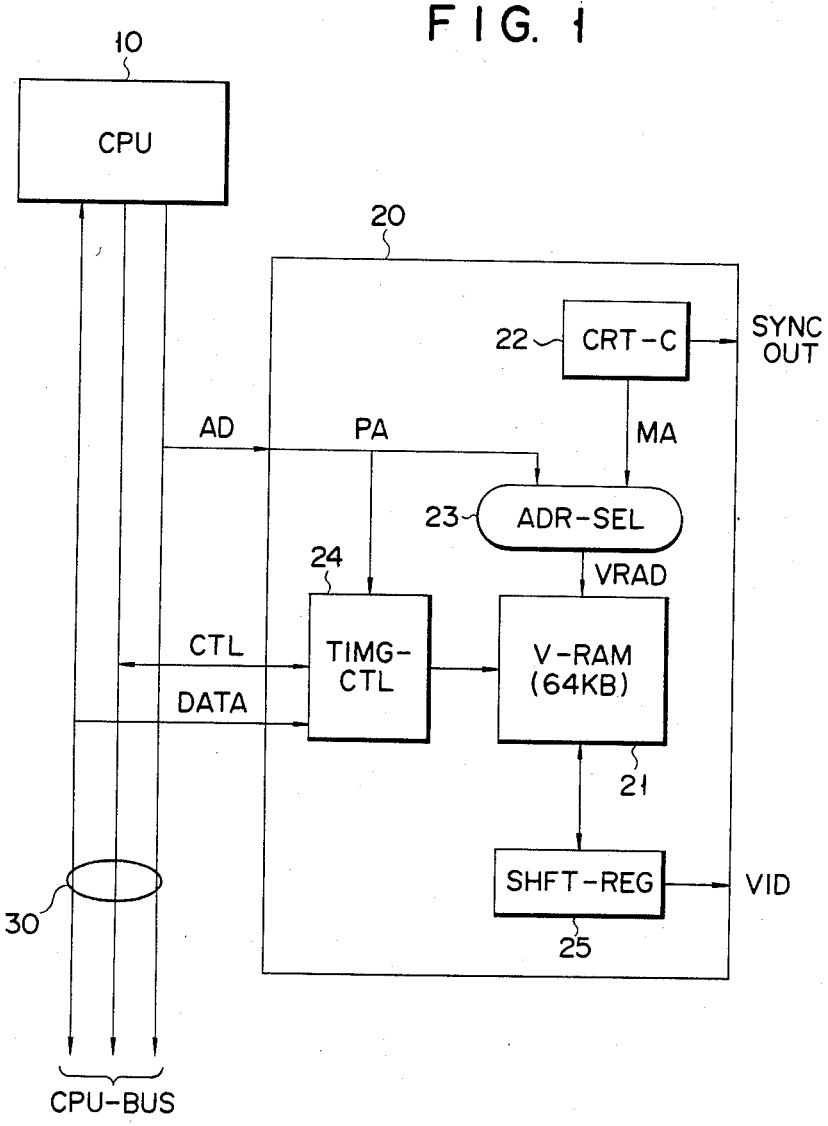
FIG. 1 is a block diagram of a first embodiment of the present invention.

FIG. 1 is a block diagram showing the overall configuration of a pattern write control circuit according to a first embodiment of the present invention. The pattern write control circuit has a central processing unit (hereinafter referred to as a CPU); a CRT display circuit 20 having a color graphic video RAM (hereinafter referred to as V-RAM) 21 comprising a dynamic memory used in a CRT display device, a control section therefor and the like; and a CPU bus 30 for transfer of address (AD), data (DATA), control signals (CTL) and the like between a CPU 10 and the CRT display circuit 20. The CRT display circuit 20 has function circuits 21 to 25 as internal elements. The function circuits 21 to 25 correspond to the video RAM 21 for color graphics comprising a dynamic memory, a CRT display control section 22 (CRT-C) for performing sync control of the CRT display device, an address selector section (ADR-SEL) 23, a timing gate control section (TIMG=CTL) 24 for performing timing control for accessing the V-RAM 21, and a shift register section (SHFT-REG) 25. The V-RAM 21 has four planes for color data (each of these four planes will be referred to as a V-RAM plane) for allowing a color display in 16 colors. Each V-RAM plane stores display dot data of one color plane for the individual color data in units of display dots. Here it is assumed that the display screen comprises a 640 dot×200 line screen and the bit width of the data to be read from or written into each V-RAM plane is 8 bits. Accordingly, the overall memory capacity of each V-RAM plane is 16 kbytes and the memory consists of eight memory blocks Mi0 to Mi7 (i=0, 1, 2, 3) each having a capacity of 16 kbits. The address selector section 23 receives a memory address (MA) from the CRT-C 22 and a processor address (PA) from the CPU 10 and selects one of these input addresses. The address selected by the address selector 23 is supplied as V-RAM address data (VRAD). The TIMG-CTL 24 has a bit mask circuit for allowing bit modification on the V-RAM 21 and a write color designation section for simultaneously supplying write data to the respective V-RAM planes. These sections will be described in detail later. The shift register section (SHIFT-REG) 25 has four plane shift registers for producing data read out from the V-RAM 21 as bit-serial video signals (VID).

Figure 2:
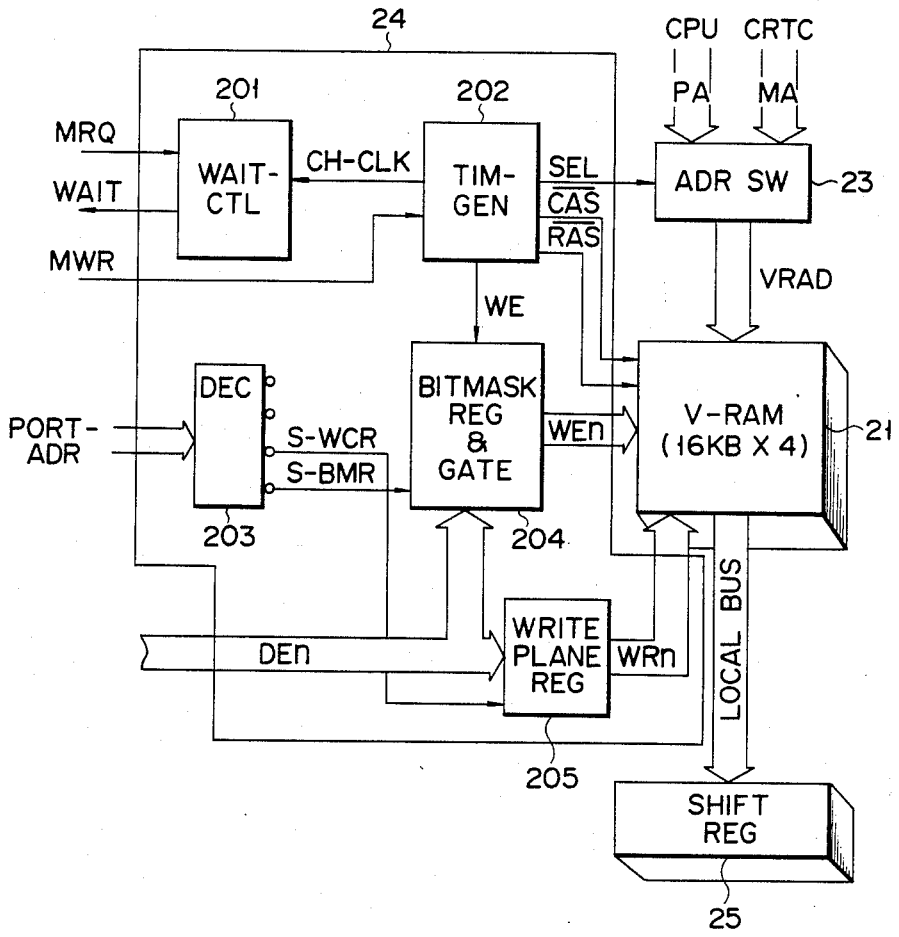
FIG. 2 is a block diagram showing the configuration of a timing gate control section in the embodiment shown in FIG. 1.

FIG. 2 is a block diagram showing in detail the configuration of the TIMG-CTL 24 shown in FIG. 1. A wait control circuit (WAIT-CTL) 201 performs timing control of a V-RAM access with the CPU 10. More specifically, upon receiving a memory request signal MRQ from the CPU 10, the wait control section 201 detects a character clock signal (CH-CLK) and supplies a wait signal WAIT until the completion of the V-RAM access to the CPU 10 by the CRT-C22. A timing generator (TIM-GEN) 202 generates various control signals for V-RAM access. In response to a memory write request signal MWR from the CPU 10, the timing generator 202 generates a character clock signal CH-CLK, an address select signal SEL, a column address select signal $\overline{CAS}$, a row address select signal $\overline{RAS}$, and a write enable signal WE. A decoder (DEC) 203 decodes a port address PORT-ADR supplied from the CPU 10. The decoder 203 supplies a bit mask register strobe signal S-BMR and a write plane register strobe signal S-WCR. A bit mask circuit 204 performs write of specific bits of each plane of the V-RAM 21, thereby allowing bit modification on the V-RAM 21. A write color designation register (hereinafter referred to as a write plane register) 205 simultaneously supplies write data of each color plane to each V-RAM of the V-RAM 21.

Figure 3:
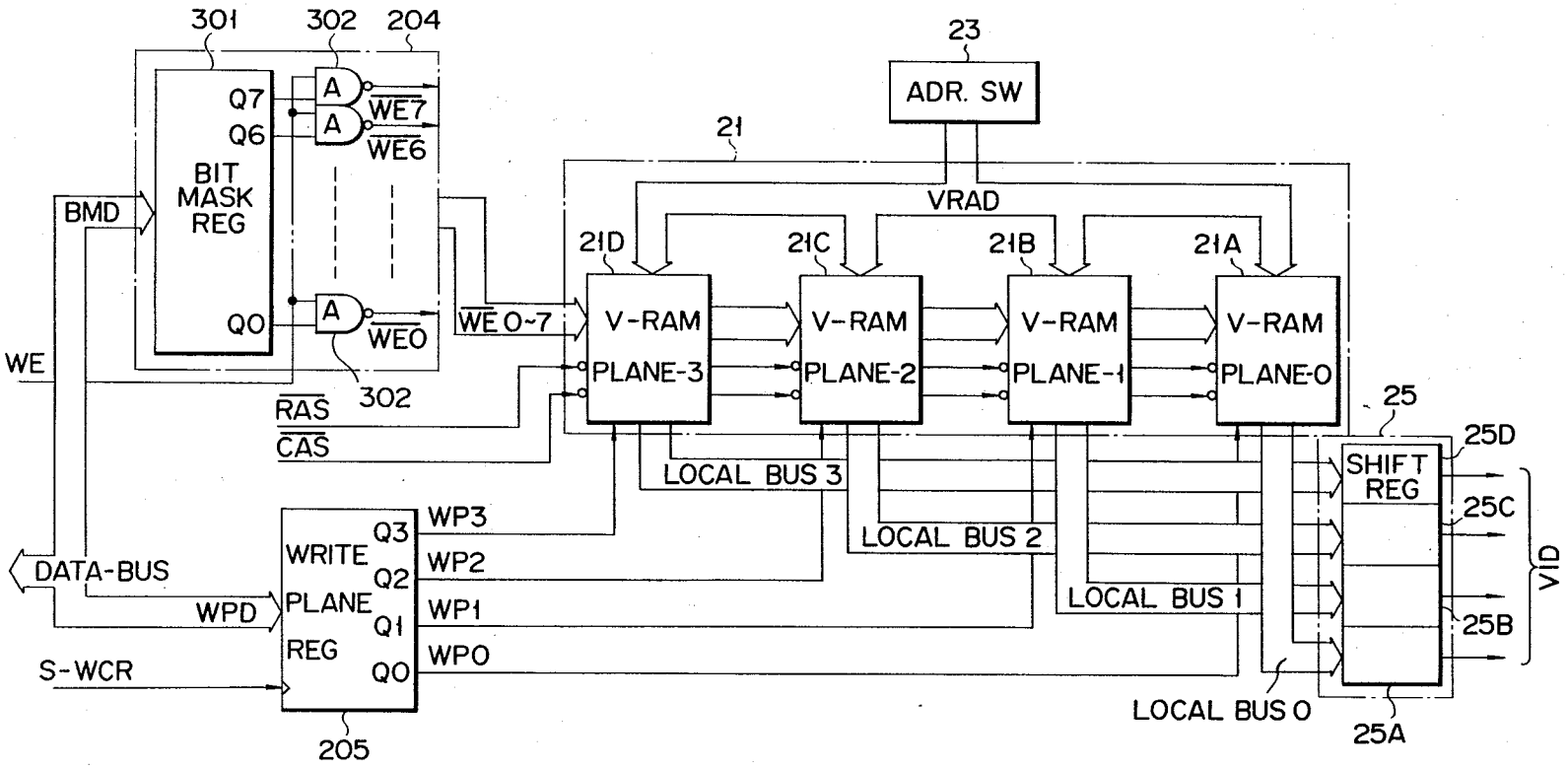
FIG. 3 is a block diagram showing the configuration of a circuit portion surrounding a V-RAM in the embodiment shown in FIG. 1.

FIG. 3 is a block diagram showing in detail the configuration of the circuit portion surrounding the V-RAM shown in FIG. 2. The V-RAM 21 consists of V-RAM planes 21A, 21B, 21C and 21D which respectively correspond to the four color planes of 16 kB. In this embodiment, the V-RAM planes 21A, 21B and 21C respectively store the dot pattern data of the corresponding planes of R (red), G (green) and B (blue). The V-RAM plane 21D stores the brightness data (full brightness levels and half brightness levels) of each display dot, thereby allowing a color display in 16 colors. The V-RAM planes 21A, 21B, 21C and 21D commonly receive V-RAM address data supplied through the address selector section 23 and are therefore simultaneously accessed in accordance with the same address. Accordingly, the address space of the CPU 10 for V-RAM access is 16 kB and the address bit width is 14 bits (7 bits×2). The shift register section 25 and a data bus (LOCAL-BUS) between the V-RAM 21 and the shift register section 25 respectively consist of four portions. The write plane register 205 latches write plane designation data (WPD: hereinafter referred to as write plane data) of 4 bit units from the CPU 10 in accordance with a write plane register strobe signal S-WCR from the decoder section 203. The write plane register 205 simultaneously supplies each bit data WP0, WP1, WP2 and WP3 to the corresponding V-RAM planes 21A, 21B, 21C and 21D as write data. The bit mask circuit 204 has a bit mask register (BIT-MASK-REG) 301 and timing gates 302. The bit mask register 301 receives bit mask data BMD from the CPU 10. Each timing gate 302 produces each bit output from the bit mask register 301 at a timing of the write enable signal WE. Write enable signals $\overline{WE0}$, $\overline{WE1}$, . . . , $\overline{WE7}$ produced from the gates 302 are commonly supplied to the V-RAM planes 21A, 21B, 21C and 21D.

Figure 4:
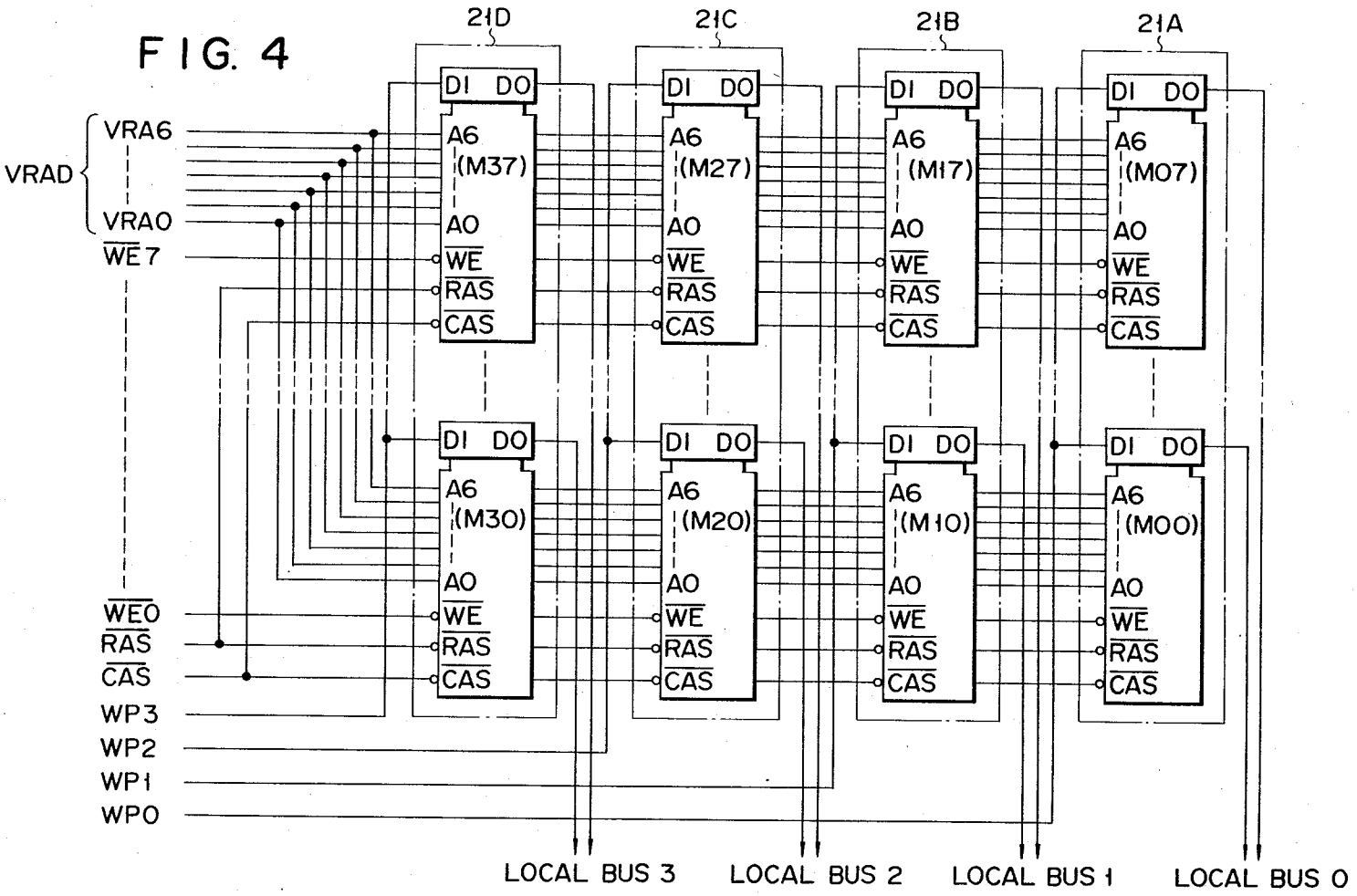
FIG. 4 is a circuit diagram showing the configuration of the V-RAM shown in FIG. 3.

FIG. 4 is a circuit diagram showing the configuration of the V-RAM 21. Referring to FIG. 4, each of the V-RAM planes 21A, 21B, 21C and 21D consists of eight 16-kbit memory blocks M0 to M7, M10 to M17, M20 to M27, or M30 to M37, respectively. Thus, each of the V-RAM planes 21A, 21B, 21C and 21D has a memory capacity of 16 kB, and the V-RAM 21 as a whole has a memory capacity of 64 kB. The V-RAM address data VRAD is commonly supplied through address lines VRA0 to VRA6 to the V-RAM planes 21A, 21B, 21C and 21D. Each address of the respective V-RAM planes 21A, 21B, 21C and 21D can be commonly accessed by two address transfer of the upper seven bits and the lower seven bits of the data VRAD. A row address select signal $\overline{RAS}$ and a column address select signal $\overline{CAS}$ are commonly supplied to the respective V-RAM planes 21A, 21B, 21C and 21D. Each bit output WP0, WP1, WP2 or WP3 from the write plane register 205 is separately supplied to the corresponding V-RAM plane 21A, 21B, 21C or 21D and is commonly supplied to data input terminals DI of the respective memory blocks M0 to M7, M10 to M17, M20 to M27 or M30 to M37 of the corresponding V-RAM plane 21A, 21B, 21C or 21D. The write enable signals $\overline{WE0}$, $\overline{WE1}$, . . . , $\overline{WE7}$ from the bit mask circuit 204 are commonly supplied to the corresponding bit positions (corresponding memory blocks) of each V-RAM plane 21A, 21B, 21C or 21D.

Figure 5:
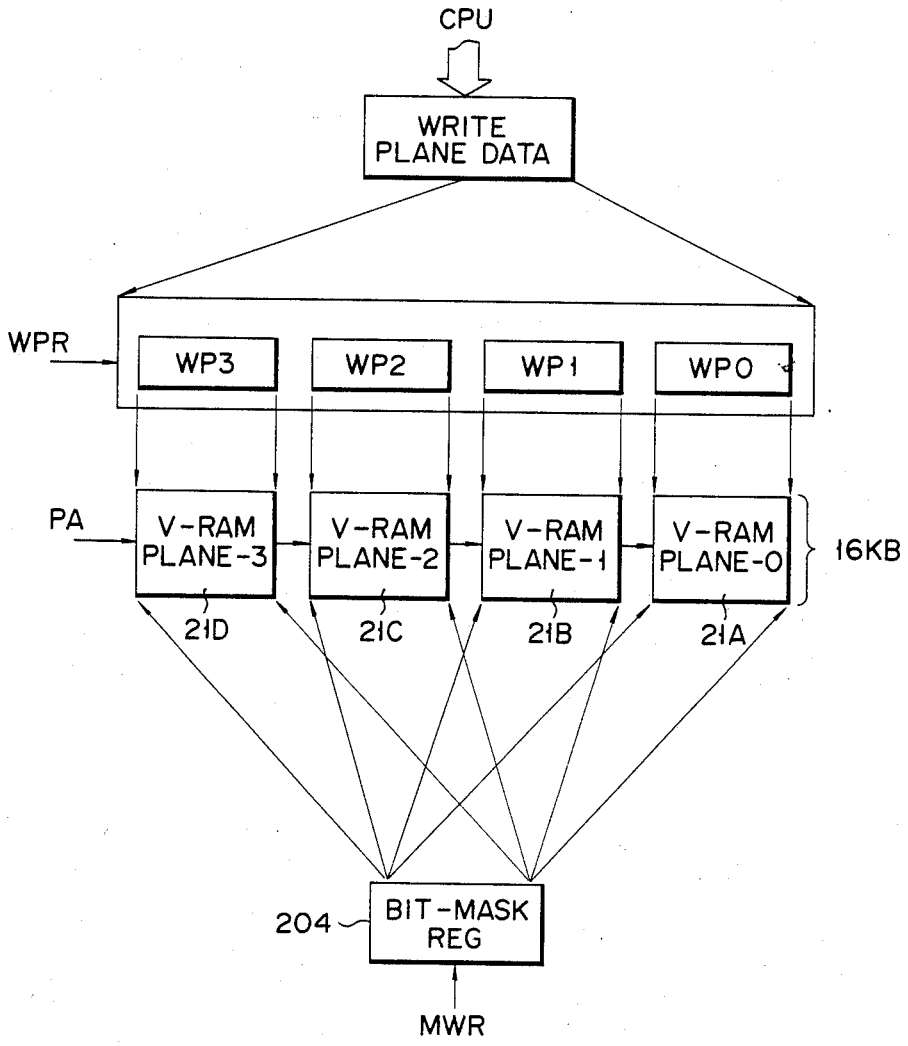
FIG. 5 is a schematic representation showing a write access control mechanism in the embodiment shown in FIG. 1.

A V-RAM write access control mechanism in the embodiment of the present invention is shown in FIG. 5. The respective V-RAM planes 21A, 21B, 21C and 21D which receive the common address and are simultaneously access-controlled are subjected to write access control by the bit selection function of the bit mask circuit 204, and the write plane designation function of the write plane register 205.

The mode of operation of the embodiment of the present invention will now be described with reference to FIGS. 1 to 5. An access of the CRT display circuit 20 to the V-RAM 21 is selectively performed by the CPU 10 and the CRT-C 22. At the timing of refresh of the CRT screen in the normal operation mode, an address select signal SEL from the timing generator 202 of the timing gate control section 24 selectively designates a memory address MA of the CRT-C 22. Thus, this memory address MA is selected by the address selector section 23 and is commonly supplied as the V-RAM address data VRAD to the respective V-RAM planes 21A, 21B, 21C and 21D of the V-RAM 21. Then, after the four types of display dot data for the respective planes which are read out from the V-RAM 21 are loaded in the corresponding plane shift registers 25A, 25B, 25C and 25D of the shift register section 25, they are supplied to the CRT display as bit-serial video signals VID. Meanwhile, a V-RAM access request from the CPU 10 is commanded by supply of a memory request signal MRQ to the wait control circuit 201 of the timing gate control section 24. In this case, a processor address PA is supplied as a memory address to the V-RAM 21. Write data is prepared in the write plane register 205, and read data is supplied onto the CPU bus 30 through a data buffer (not shown). These operations are performed in accordance with signals from the timing gate control section 24. The wait control circuit 201 of the timing gate control section 24 supplies a wait signal WAIT to the CPU 10 until the memory access to the V-RAM 21 is completed. The timing generator 202 of the timing gate control section 24 supplies an address select signal SEL for selectively designating a processor address PA to the address selector section 23 when the CPU 10 can access the V-RAM 21. The timing gate control section 24 further produces a row address select signal $\overline{RAS}$, a column address select signal $\overline{CAS}$, a write enable signal WE and the like for controlling the V-RAM 21. Of these signals, the row address select signal $\overline{RAS}$ and the column address select signal $\overline{CAS}$ are directly supplied to the respective V-RAM planes 21A, 21B, 21C and 21D of the V-RAM 21 at this timing. The write enable signal WE is supplied to the bit mask circuit 204 when a memory write request signal MWR is generated from the CPU 10 and a CPU access to the V-RAM 21 is to be performed. The bit mask circuit 204 is defined as one address register as viewed from the CPU 10 and allows setting of any given value therein. In response to a bit mask register strobe signal S-BMR from the decoder 203 which is produced in response to a port address PORT-ADR from the CPU 10, the register 301 latches 8-bit mask data BMD. The write enable signal WE described above is commonly supplied to the respective output gates 302 of the mask register 301. At the timing of the write enable signal WE, the write enable signal $\overline{WEi}$ is supplied to the bit positions or memory blocks Mi of each V-RAM plane 21A, 21B, 21C or 21D which correspond to the bits of the bit mask register 301 which are set (bit at logic level "1"). In this manner, writing into only desired bits of the V-RAM plane 21A, 21B, 21C or 21D of the V-RAM 21 can be performed. For example, when a need arises for turning on only the bit 3 of a certain address of the V-RAM planes 21A and 21B with the definition that the most significant bit is bit 7 and the least significant bit is bit 0, a binary signal "00001000" is set in the bit mask register 301. Write plane data WPD for setting the bit outputs WP1 and WP2 at logic level "1" are set in the write plane register 205 to be described in detail later, and given data is written at this address. This given data is dummy data and the data to be actually written is the content (WPD) of the write plane register 205. When a need for turning off the bit 3 of this address arises, WP0 and WP1 of the write plane data WPD are set at logic level "0" and a write operation as described above is performed. If a plurality of bits of the bit mask register 301 are turned on, the bits of the respective V-RAM planes 21A, 21B, 21C and 21D which correspond to these bits are subject to write operation. The write plane for this write operation depends on the contents of the data WPD of the write plane register 205. If a byte access (or word access) is requested, all the bits of the bit mask register 301 are set. In this manner, the bits to be modified can be arbitrarily designated by the bit mask means.

The mode of operation of the write plane register 205 will now be described. As in the case of the bit mask circuit 204, the write plane register 205 receives write plane data WPD supplied from the CPU 10 as needed for accessing the V-RAM 21. The write plane register 205 then simultaneously supplies this data to the V-RAM planes 21A, 21B, 21C and 21D in units of bits (WP0, WP1, WP2 and WP3). Thus, in response to a plane select register strobe signal S-PSR supplied from the decoder 203 in accordance with the port address PORT-ADR from the CPU 10, the write plane register 205 latches 4-bit write plane data PSD from the CPU 10. The respective bit outputs WP0, WP1, WP2 and WP3 from the write plane register 205 are supplied as write data to the corresponding V-RAM planes 21A, 21B, 21C and 21D. Then, each V-RAM plane 21A, 21B, 21C or 21D commonly receives the corresponding bit outputs WP0, WP1, WP2 and WP3 at the respective memory blocks M0 to M7, M10 to M17, M20 to M27 or M30 to M37. In other words, the respective bit outputs WP0, WP1, WP2 or WP3 of the write plane register 205 become the common write bits (8-bit all "1" or all "0") for each of the memory blocks M0 to M7, M10 to M17 and so on of the V-RAM planes 21A, 21B, 21C and 21D. Accordingly, if the bit WP0 of the write plane data WPD stored in the write plane register 205 is set at "0" and the contents of the bit mask register 301 are all "0", all "0" is written in units of bytes (in units of 8 bits) in the V-RAM plane 21A. Such write operation is simultaneously performed for each of the remaining planes. Then, common data for the respective planes can be written at high speed (e.g., screen clear, solid display or the like). When the bit mask function as described above is utilized, set ("1" write) and reset ("0" write) of a desired color for each bit can be performed at high speed upon a single V-RAM access.

A pattern write into the V-RAM 21 using the functions of the bit mask circuit 204 and the write plane register 205 will now be described.

When a screen clear is to be performed by a software request, all "0" is written on the entire area of the V-RAM 21. In this case, the bit mask data BMD of all "1" ("11111111") is set in the bit mask register 301 of the bit mask circuit 204 in the manner described above. The write plane data WPD of all "0" ("0000") is set in the write plane register 205. In response to a write enable signal WE, the output gates 302 of the bit mask circuit 204 produce all "0" write enable signals $\overline{WE0}$, $\overline{WE1}$, . . . , $\overline{WE7}$ for enabling write of all the eight bits. The write plane register 205 supplies the respective bit outputs WP0, WP1, WP2 and WP3 (="0") to the corresponding V-RAM planes 21A, 21B, 21C and 21D. By the write bit designation by the bit mask circuit 204 and the write color designation by the write plane register 205, write operation can be performed for the common address for all the V-RAM planes 21A, 21B, 21C and 21D. Thus, "0" write or a screen clear can be performed in units of bytes simultaneously for the respective V-RAM planes 21A, 21B, 21C and 21D.

When a solid display in a specific color is to be performed, an operation substantially the same as that described with reference to a screen clear is performed at high speed.

When a dot pattern of a specific color is to be written at a specific position on the screen by a software request, the CPU 10 calculates a processor address PA and a bit position corresponding to such position. The bit mask data BMD having a bit pattern in which the corresponding bit position is set at "1" is set in the bit mask registers 301 of the bit mask circuit 204. A value corresponding to the specified color is set in the write plane register 205, and given data is written at the address PA. The given address is dummy data for executing write into the V-RAM 21, and actual write data to be written in the V-RAM 21 is the write plane data WPD stored in the write plane register 205.

In this manner, the dot pattern in a desired color can be written at only desired positions on the screen.

Since the pattern write control into the V-RAM 21 as described is performed, patterns of given colors can be simultaneously written into a plurality of V-RAM planes 21A, 21B, 21C and 21D of the V-RAM 21. For this reason, writing of the patterns can be performed at high speed. Since the CPU 10 can handle the color planes (four planes) in the superposed state, the V-RAM 21 can be accessed with an extremely narrow address space.

Figure 6:
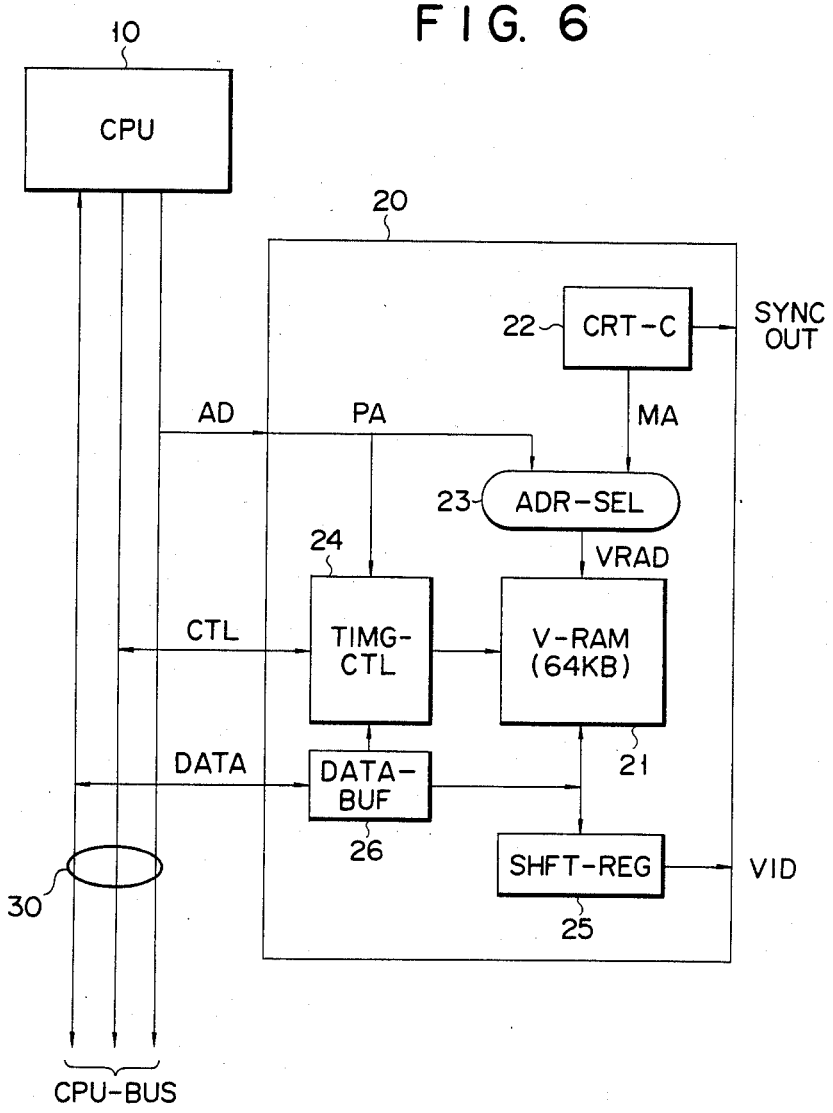
FIG. 6 is a block diagram showing a second embodiment of the present invention.

FIG. 6 is a block diagram showing the overall configuration of another embodiment of the present invention. The same reference numerals as in FIG. 1 denote the same parts in FIG. 6 and a detailed description thereof will be omitted. The embodiment shown in FIG. 6 is different from that shown in FIG. 1 in that the circuit has a data buffer section 26 (of four buffer configuration) for simultaneously storing the read/write data of the V-RAM 21 for the respective planes.

Figure 7:
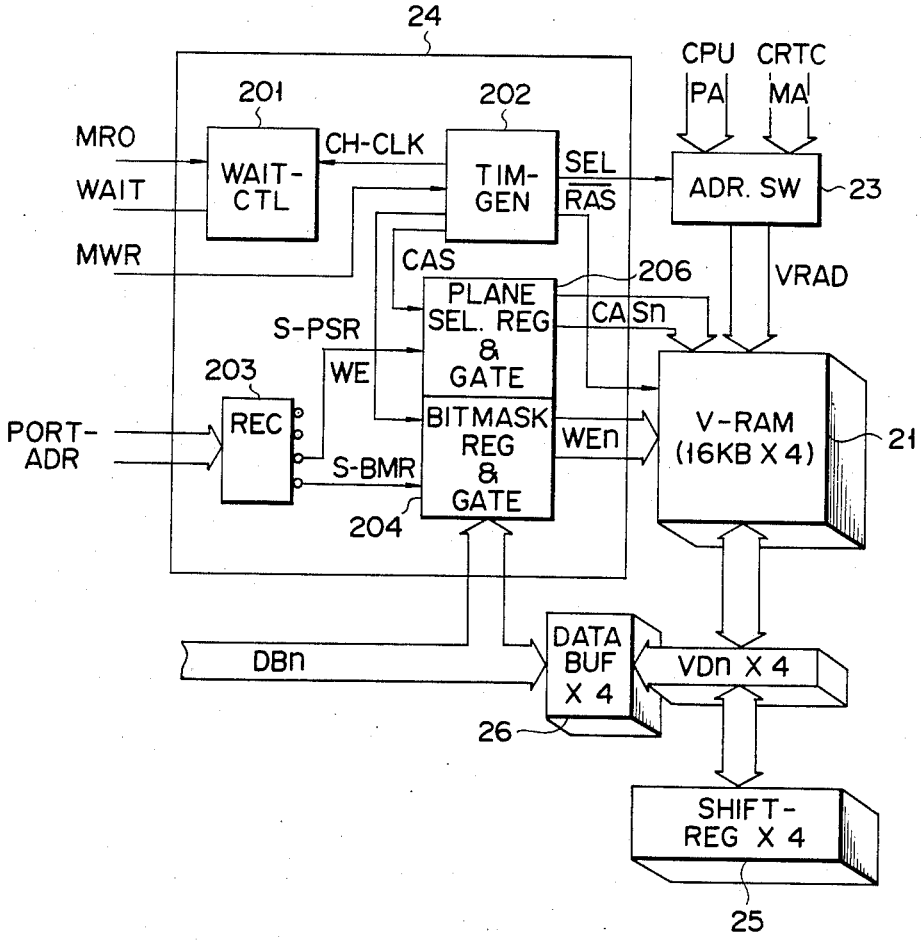
FIG. 7 is a block diagram showing the configuration of a timing gate control section in the embodiment shown in FIG. 6.

FIG. 7 is a block diagram showing in detail the configuration of a timing gate control section 24 of the circuit shown in FIG. 6. The same reference numerals as in FIG. 2 denote the same parts as in FIG. 7 and a detailed description thereof will be omitted. Referring to FIG. 7, reference numeral 206 denotes a color plane selector for simultaneously selecting a plurality of planes of the V-RAM. In this embodiment, the color plane selector 206 selectively supplies a column address select signal $\overline{CAS}$ to the four V-RAM planes so as to enable/prohibit access f the desired ones of the planes.

Figure 8:
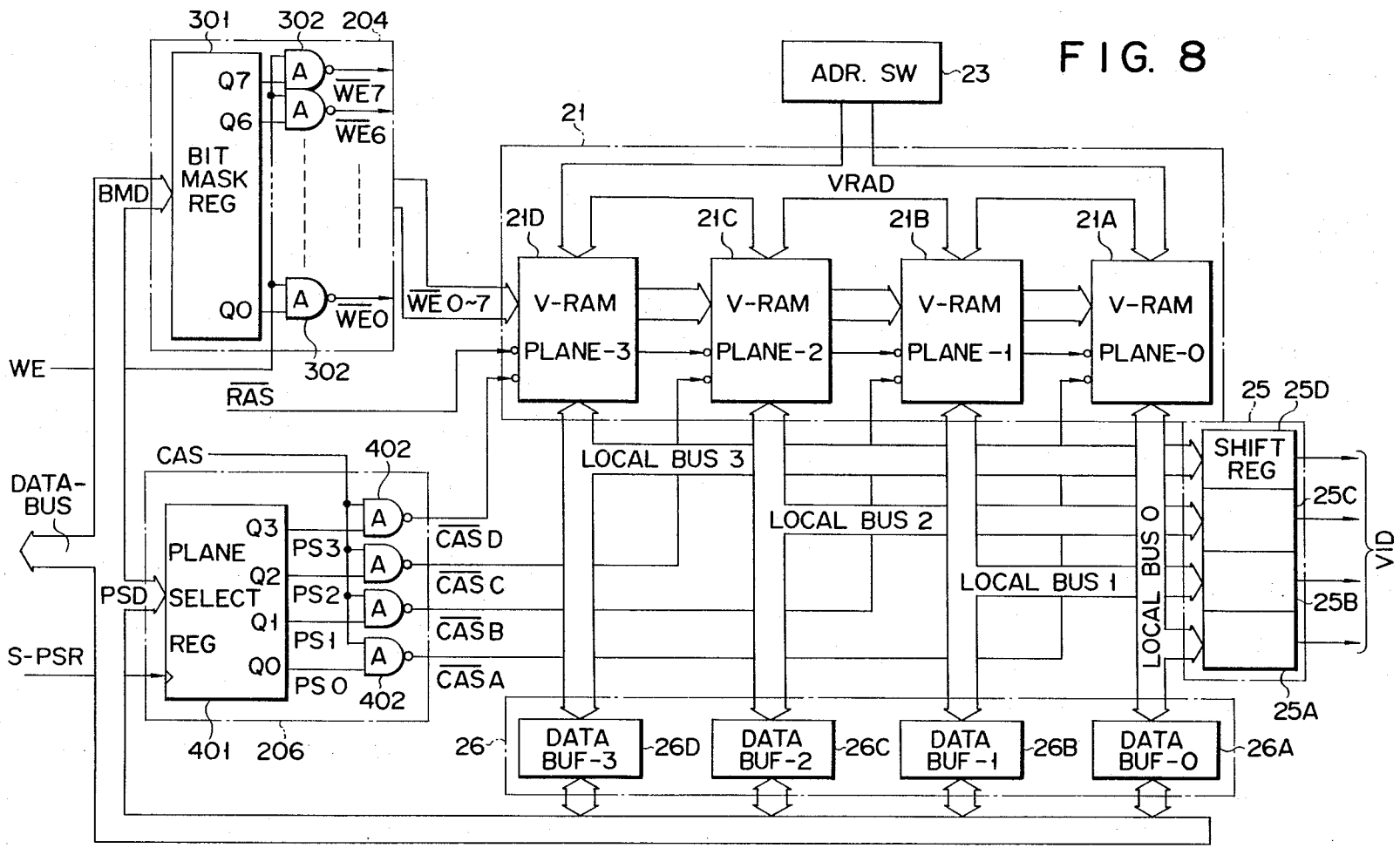
FIG. 8 is a block diagram showing the configuration of a circuit portion surrounding a V-RAM in the embodiment shown in FIG. 6.

FIG. 8 is a block diagram showing in detail the configuration of a circuit portion surrounding the V-RAM shown in FIG. 7. The same reference numerals as in FIG. 3 denote the same parts as in FIG. 7, and a detailed description thereof will be omitted. In this embodiment, a data buffer section 26, a shift register section 25, and a data bus (LOCAL-BUS) between the V-RAM and the data buffer section respectively have four portions corresponding to those of the V-RAM planes 21A, 21B, 21C and 21D. Reference numerals 26A, 26B, 26C and 26D are plane data buffers which respectively correspond to the V-RAM planes 21A, 21B, 21C and 21D.

The color plane selector 206 has a plane select register (PLANE-SELECT-REG) 401 and gates 402. The plane select register 401 receives plane select data PSD from the CPU 10. The gates 402 separately receive the respective bit outputs PS0, PS1, PS2, . . . , PS3 from the plane select register 401 and commonly receive a column address select signal CAS. When the corresponding bit output from the plane select register 401 is set at "1", the gates 402 produce column address select signals $\overline{CASA}$, $\overline{CASB}$, $\overline{CASC}$ and $\overline{CASD}$ corresponding to the respective planes. The outputs from the gates 402 are respectively supplied to the corresponding V-RAM planes 21A, 21B, 21C and 21D.

Figure 9:
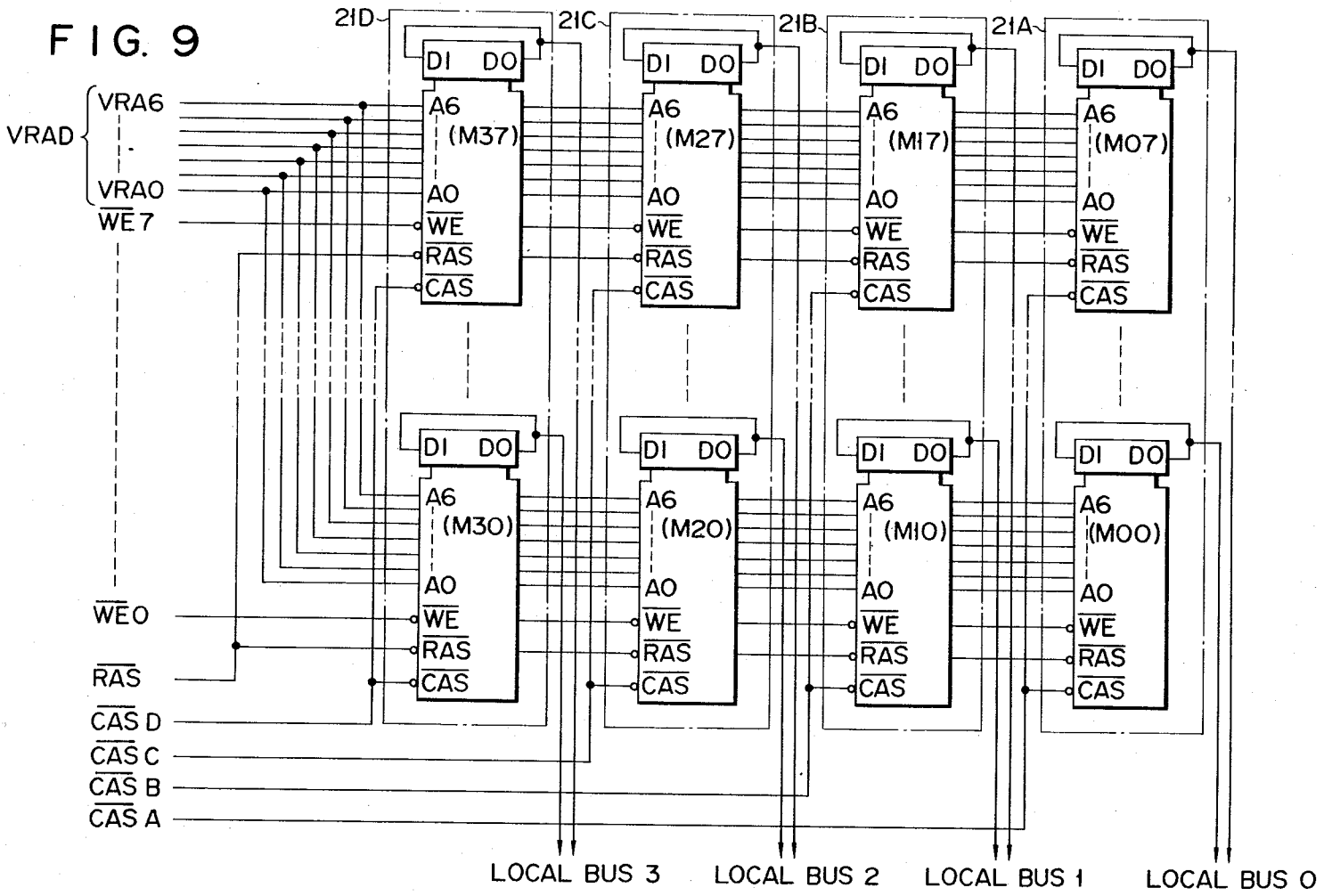
FIG. 9 is a circuit diagram showing the configuration of the V-RAM of the embodiment shown in FIG. 6.

FIG. 9 is a circuit diagram showing the configuration of the V-RAM 21 according to the second embodiment shown in FIG. 8.

Referring to FIG. 8, a row address select signal $\overline{RAS}$ is commonly supplied to the V-RAM planes 21A, 21B, 21C and 21D. The column address signals $\overline{CASA}$, $\overline{CASB}$, $\overline{CASC}$ and $\overline{CASD}$ supplied from the color plane selector 206 are separately supplied to the corresponding V-RAM planes 21A, 21B, 21C and 21D, respectively. The write enable signals $\overline{WE0}$, $\overline{WE1}$, $\overline{WE2}$, . . . , $\overline{WE7}$ from the bit mask circuit 204 are commonly supplied to the corresponding bit positions (corresponding memory blocks) of the respective V-RAM planes 21A, 21B, 21C and 21D.

Figure 10:
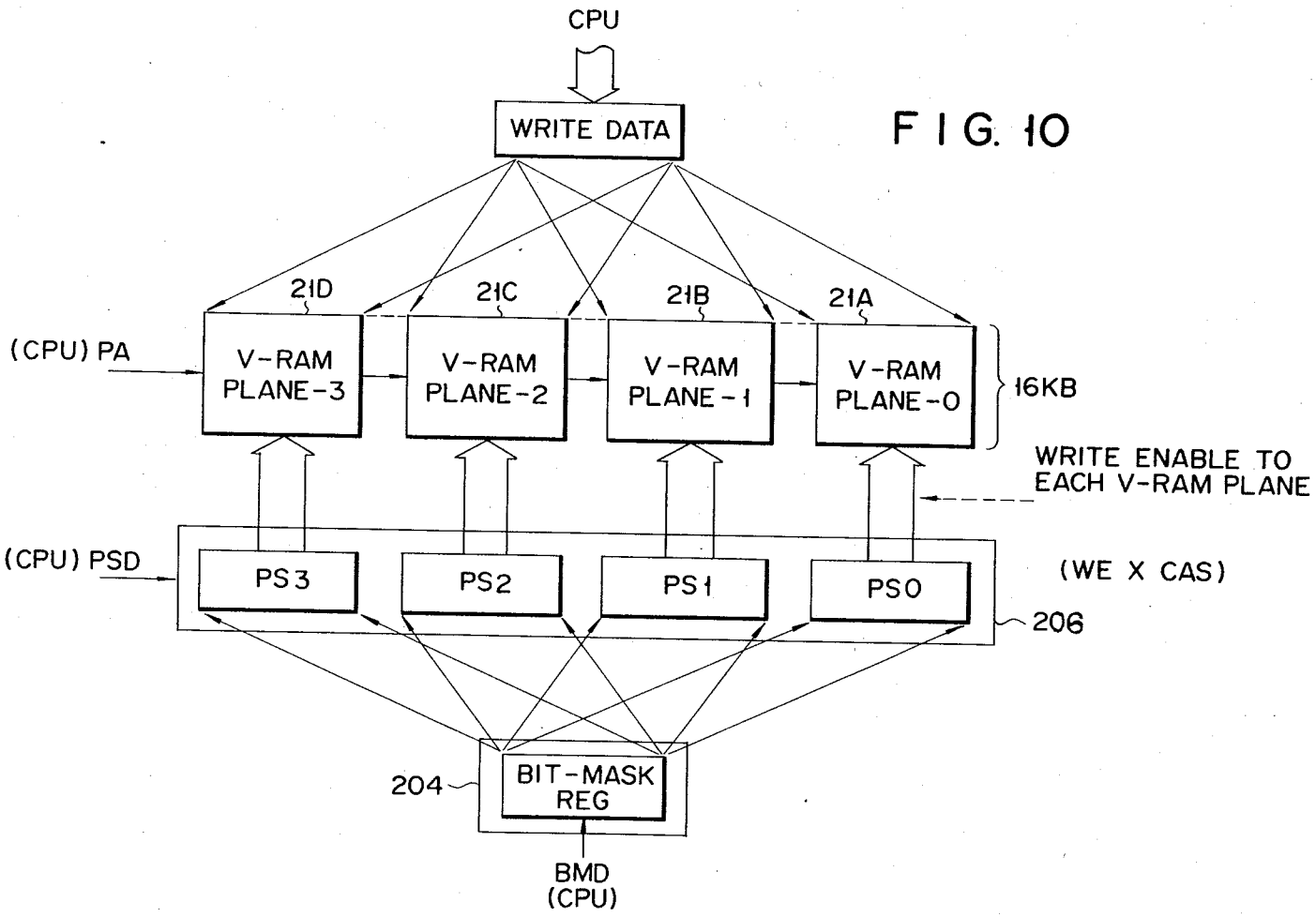
FIG. 10 is a schematic representation showing a write access control mechanism in the embodiment shown in FIG. 6.

FIG. 10 is a representation showing the V-RAM write access control mechanism of the second embodiment shown in FIG. 6. The respective V-RAM planes 21A, 21B, 21C and 21D commonly receive a common address and allow simultaneous access. Thus, write access control can be selectively and simultaneously performed by the bit selection function of the bit mask circuit 204 and the plane selection function of the color plane selector 206.

The mode of operation of the second embodiment shown in FIGS. 6 to 10 will now be described. In this embodiment, a processor address PA is supplied as a memory address to the V-RAM 21. Write data is set in the respective plane data buffers 26A, 26B, 26C and 26D of the data buffer section 26. Alternatively, read data is supplied onto the CPU bus 30 through the buffer section 26. A row address select signal $\overline{RAS}$ is directly and commonly supplied to the V-RAM planes 21A, 21B, 21C and 21D, and a column address select signal CAS is separately supplied through the color plane selector 206 to the respective V-RAM planes 21A, 21B, 21C and 21D of the V-RAM 21 as the corresponding column address select signals $\overline{CASA}$, $\overline{CASB}$, $\overline{CASC}$ and $\overline{CASD}$. In this embodiment, when a need arises for turning on the bit 3 of the V-RAM planes 21A and 21B selected by the color plane selector 206, a binary signal "00001000" is set in the bit mask register 301. Thereafter, all "1" data (data "FF" HEX) is written at this address. Conversely, when a need arises for turning off the bit 3 of this address, all "0" data (data "00" HEX) is written at this address. If a plurality of bits of the bit mask register 301 are on and the V-RAM planes 21B and 21C, for example, are selected by the color plane selector 206, the bits of the respective V-RAM planes 21B and 21C are subject to write operation. If a byte access (or word access) is required, all "1" data is set in the bit mask register 301. In this manner, the bits to be modified can be easily designated.

The mode of operation of the color plane selector 206 will be described below. The color plane selector 206 is rendered operative in response to data PSD supplied from the CPU 10 as needed for performing a V-RAM write access, as in the case of the bit mask circuit 204. The color plane selector 206 allows write access for the V-RAM planes which are designated by the data PSD. In response to a plane select register strobe signal S-PSR from the decoder 203 supplied in accordance with a port address PORT-ADR from the CPU 10, the plane select register 401 of the color plane selector 206 latches the 4-bit plane select data PSD from the CPU 10. The respective bit outputs PS0, PS1, PS2, and PS3 from the color plane selector 206 are supplied to one input terminal of each of the gates 402, the other input terminal of each of which commonly receives the column address select signal CAS. When the color plane selector 206 receives a column address select signal CAS after the reception of the plane select data PSD, it supplies those of column address select signals $\overline{CASA}$, $\overline{CASB}$, $\overline{CASC}$ and $\overline{CASD}$ for he respective planes from only the output gates 402 which correspond to the data PSD set in the color plane selector 206. When the plane select data PSD; (Q3, Q2, Q1, Q0)=(1, 1, 1, 0) for setting the bit output PS0 at "0" and the other bit outputs PS1 to PS3 at "1" for selecting the V-RAM planes 21A, 21B and 21C is set in the color plane selector 206 and the column address select signal CAS (="1") is generated, those of column address select signals $\overline{CASA}$, $\overline{CASB}$ and $\overline{CASC}$ of effective level, that is, of level "0" corresponding to those of the gates 402 which have received the signals of "1" from the color plane selector 206 are generated. The column address select signals $\overline{CASA}$, $\overline{CASB}$ and $\overline{CASC}$ from the gates 402 are supplied to the corresponding V-RAM planes 21A, 21B and 21C. Thus, of the V-RAM planes 21A, 21B, 21C and 21D, the V-RAM planes 21A, 21B and 21C other than the V-RAM plane 21D allow simultaneous write access.

In this manner, the bits of the V-RAM planes 21A, 21B, 21C and 21D which are set at logic "1" or logic "0", are designated by the bit mask circuit 204. The color planes are selected by the color plane selector 206. Dot patterns are simultaneously written at the bit positions of the selected planes which are thus designated.

An example of pattern written into the V-RAM 21 utilizing the functions of the bit mask circuit 204 and the color plane selector 206 will now be described.

When a screen clear is to be performed by a software request, all "0" data is written in the entire area of the V-RAM 21 from the CPU 10. At this time, all "1" bit mask data BMD ("11111111") is set in the bit mask register 301 of the bit mask circuit 204. Similarly, all "1" plane select data PSD ("1111") is set in the plane select register 401 of the color plane selector 206. All "0" write data is stored in the plane data buffers 26A, 26B, 26C and 26D. Then, all outputs for enabling write of all the eight bits and write enable signals $\overline{WE0}$, $\overline{WE1}$, . . . , $\overline{WE7}$ of "0" are produced from the output gates 302 of the bit mask circuit 204. In accordance with the column address select signal CAS, the output gates 402 of the color plane selector 206 produce column address select signals $\overline{CASA}$, $\overline{CASB}$, $\overline{CASC}$ and $\overline{CASD}$ of "0" for enabling write into all the four planes. Upon such write bit designation by the bit mask circuit 204 and a write plane selection by the color plane selector 206, write operation is performed for a common address for the respective V-RAM planes 21A, 21B, 21C and 21D. Accordingly, "0" writing, that is, a screen clear is performed in units of bytes for all the V-RAM planes 21A, 21B, 21C and 21D, simultaneously.

When a solid display is to be performed, a high-speed write operation may be performed in a similar manner to that described with reference to a screen clear above.

When a dot pattern of a specific color is to be written at a specific position on the screen, the CPU 10 calculates a processor address PA corresponding to the desired position and the bit position. Then, the CPU 10 sets the bit mask data BMD having a bit pattern configuration for setting this bit position "1" in the bit mask register 301 of the bit mask circuit 204. Furthermore, the CPU 10 sets the plane select data PSD corresponding to a selected color in the plane select register 401 of the color plane selector 206 and thereafter writes all "1" data in the address PA. Then, the dot pattern of the selected color is written at the position of the memory which corresponds to the desired the screen. When a color at a certain position on the screen is to be cleared, the data is similarly set in the bit mask register 301, all "1" plane select data PSD is set in the plane select register 401, and all "0" data is written at the address of the memory corresponding to the designated position.

Figure 11:
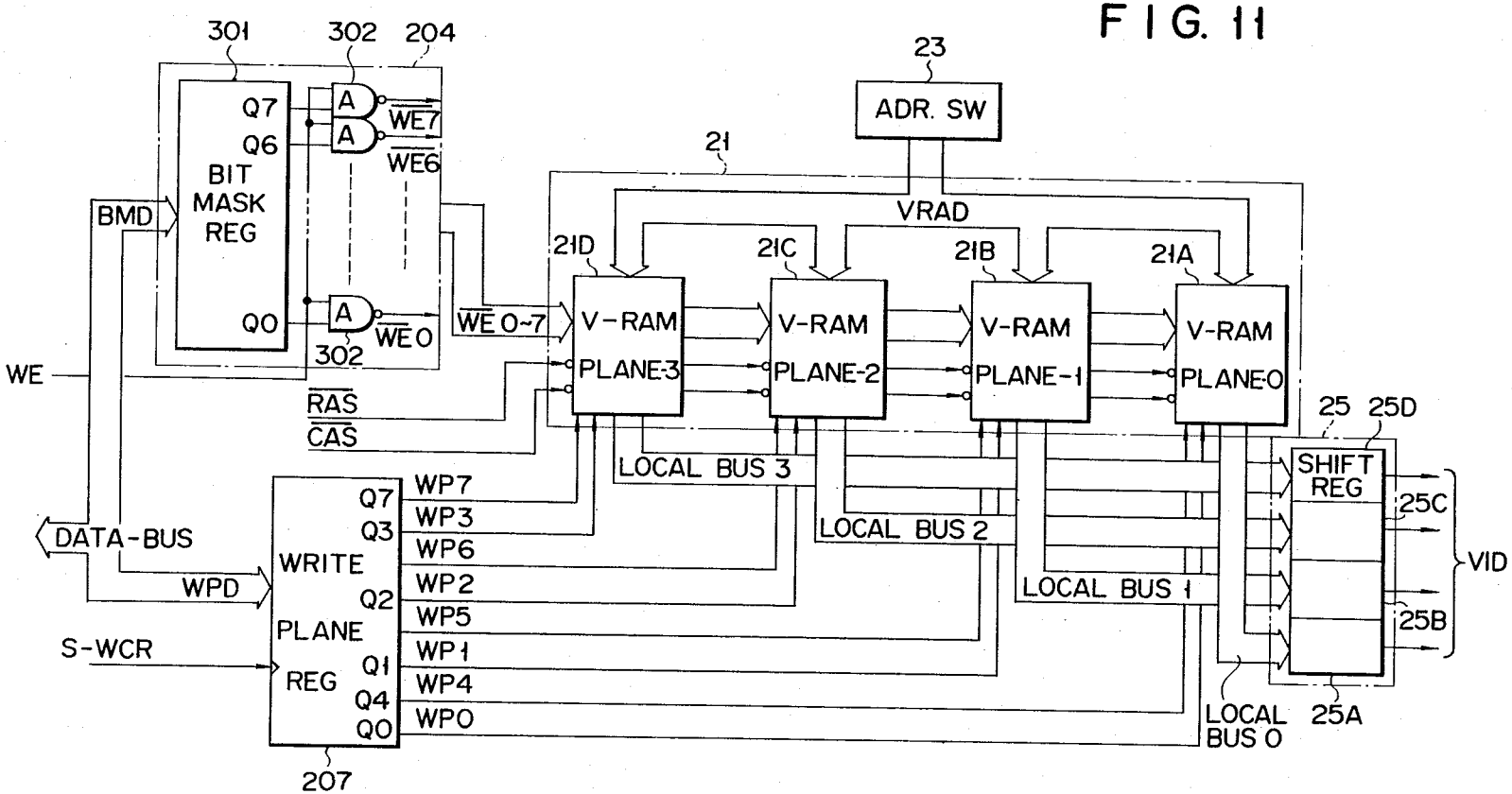
FIG. 11 is a block diagram showing the configuration of a circuit portion surrounding a V-RAM of a third embodiment of the present invention.
Figure 12:
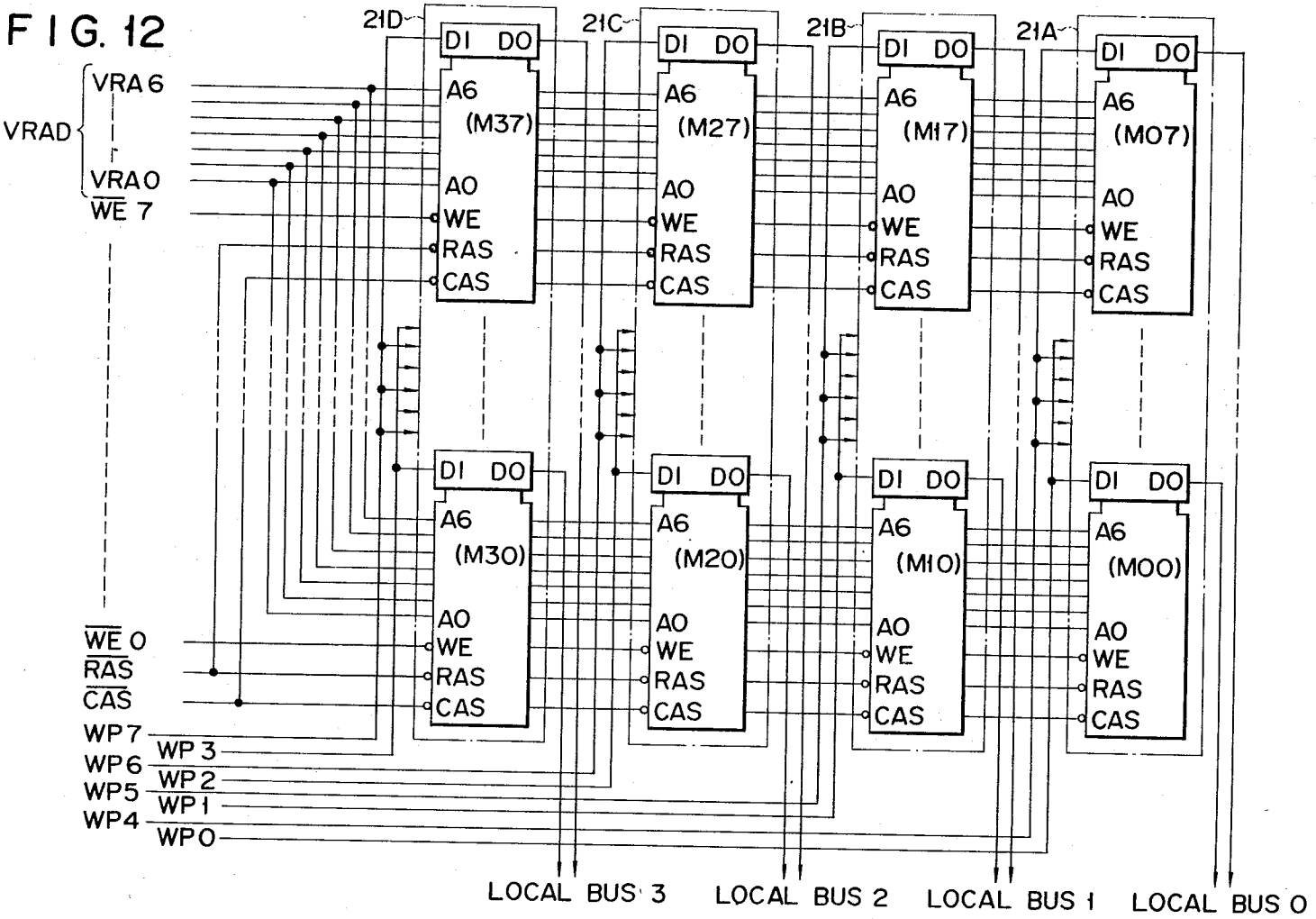
FIG. 12 is a circuit diagram showing the configuration of the V-RAM according to the third embodiment of the present invention.

FIG. 11 is a block diagram showing in detail the configuration of a circuit portion surrounding the V-RAM according to a third embodiment of the present invention. In this embodiment, in response to a write plane register strobe signal S-WCR supplied from a decoder 203, a write plane register 207 latches 8-bit (4×2-bit) write plane designation data WPD (hereinafter referred to as write plane data) from a CPU 10. Then, the write plane register 207 simultaneously supplies the respective output data WP0, WP1, WP2, and WP3; and WP4, WP5, WP6 and WP7 to the corresponding V-RAM planes 21A, 21B, 21C and 21D, as write data FIG. 12 is a circuit diagram showing in detail the configuration of the V-RAM of the third embodiment of the present invention.

A row address select signal $\overline{RAS}$ and a column address select signal $\overline{CAS}$ are commonly supplied to the V-RAM planes 21A, 21B, 21C and 21D of the V-RAM 21. The respective bit outputs WP0, WP1, WP2, and WP3 and WP0, WP1, WP2 and WP3 from the write plane register 207 are separately supplied to the corresponding V-RAM planes 21A, 21B, 21C and 21D in predetermined 2-bit combinations of WP0 WP4, WP1 WP5, WP2 WP6, and WP3 WP7. For each plane, these data are alternately supplied to the data input terminals DI of respective memory blocks M0 to M7, M10 to M17, M20 to M27 or M30 to M37. When the case of the V-RAM plane 21A is considered, the output WP0 is commonly supplied to the data input terminals DI of the memory blocks M0, M2, M4 and M6 which correspond to the even-numbered bit positions of the write operation. However, the output WP4 is commonly supplied to the data input terminals DI of the memory blocks M1, M3, M5 and M7 which correspond to odd-numbered bit positions. A similar write plane data supply process is performed for each of the remaining V-RAM planes 21B, 21C and 21D. The write enable signals WE0, WE1, . . . , WE7 from the bit mask circuit 204 are commonly supplied to the corresponding bit positions (corresponding memory blocks) of the respective V-RAM planes 21A, 21B, 21C and 21D.

Figure 13:
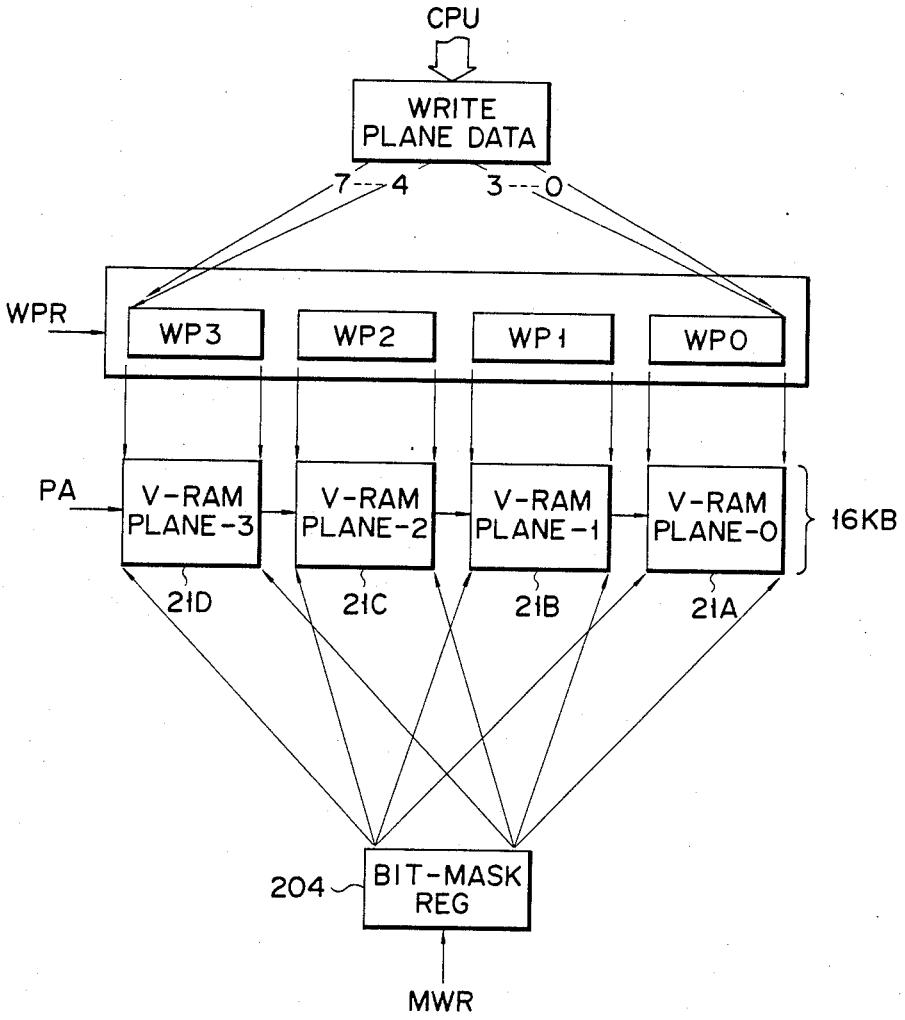
FIG. 13 is a schematic representation showing a write access control mechanism in the third embodiment.

FIG. 13 is a representation showing a V-RAM write access control mechanism according to the embodiment of the present invention. Each V-RAM plane 21A, 21B, 21C or 21D receives a common address and allows simultaneous write access. Write access control of these V-RAM planes is performed by the bit selection function of the bit mask circuit 204 and the write plane designation function of the write plane register 207.

When a need arises for turning on only the bit 3 of a certain address of, example, V-RAM planes 21A and 21B in this embodiment, a binary signal "00001000" is set in the bit mask register 301. Further, the write plane data WPD for setting the bit outputs WP4 and WP5 to "1" is set in the write plane register 207 to be described later. Thereafter, given data is written at the address. This given data is dummy data, and actual write data to be written at this address is the contents (WPD) of the write plane register 207. When a need for turning off the bit 3 of this address arises, the outputs WP4 and WP5 of the write plane data WPD are set at "0", and a similar write operation is performed. If a plurality of bits of the bit mask register 301 are set, the bits of the V-RAM planes 21A, 21B, and 21C corresponding to these output bits are subject to a write operation. The write plane at this time is determined by the contents of the data WPD from the write plane register 207. If a byte access (or a word access) is required, all the bits of the bit mask register 301 are set. Bits to be modified can be arbitrarily designated by the bit mask means described above.

The mode of operation of the write plane register 207 will now be described. As in the case of the bit mask circuit 204 described above, the write plane register 207 receives the write plane data WPD from the CPU 10 supplied as needed in accordance with the V-RAM write access from the CPU 10. Then, the write plane register 207 simultaneously supplies the data WPD to the V-RAM planes 21A, 21B, 21C and 21D in units of 2 bits WP0·WP4, WP1·WP5, WP2·WP6, or WP3·WP7. In response to a plane select register strobe signal S-PSR from the decoder 203 which is supplied in accordance with a port address PORT-ADR from the CPU 10, the write plane register 207 latches 8-bit plane select data PSD from the CPU 10. Then, the respective bit outputs WP0, WP1, WP2, WP3, and WP4, WP5, WP6 and WP7 from the write plane register 207 are supplied as write data (color data) to the corresponding V-RAM planes 21A, 21B, 21C and 21D in the forms of 2-bit combinations of WP0 WP4, WP1 WP3, and so on. Then, each V-RAM plane 21A, 21B, 21C or 21D alternately (at every other bit) receives the corresponding bit outputs WP0·WP4, WP1·WP5, WP2·WP6, or WP3·WP7 at the respective memory blocks M0 to M7, M10 to M17, M20 to M27, or M30 to M37, respectively. Thus, the respective bit outputs WP0, WP1, WP2, and WP3; and WP4, WP5, WP6, and WP7 from the write plane register 207 are combined in the 2-bit combinations as described above and become the every other common write bits (all "1" or "0" for even or odd four bits) of the respective memory blocks M0 to M7, M10 to M17, and so on for the respective V-RAM planes 21A, 21B, 21C and 21D. If the bits WP0 and WP4 of the write plane data WPD stored in the write plane register 207 are both "0" and the contents of the bit mask register 301 are all "1", all "0" is written in units of bytes (8 bits) in the V-RAM plane 21A. A similar write operation is performed for each of the remaining V-RAM planes. Such write operation (e.g., a screen clear, a solid display or the like) for each plane can be performed at high speed. In addition to this, by using the bit mask function as described above as well, set ("1" write) or reset ("0" write) for each dot and timing write can be performed at high speed by a single V-RAM access.

The mode of operation for writing various patterns including a tiling write into the V-RAM 21 utilizing the various functions of the bit mask circuit 204 and the write plane register 207 will now be described.

When a screen clear is to be performed by a software request, all "0" data is written in all the areas of the V-RAM 21 by the CPU 10. As has been described above, all "1" bit mask data BMD ("11111111") is set in the bit mask register 301 of the bit mask circuit 204. Similarly, all "0" write plane data WPD ("00000000") is set in the write plane register 207. In accordance with the write enable signal WE, the output gates 302 of the bit mask circuit 204 produce and all "0" write enable signals WE0, WE1, . . . , WP7 for enabling write into all the eight bits. The write plane register 207 supplies the respective bit outputs WP0, WP1, . . . , WP7 as write data to the corresponding V-RAM planes 21A, 21B, 21C and 21D. In accordance with a bit designation function of the bit mask circuit 204 and a write color designation by the write plane register 207, a write operation is performed with a common address for all the addresses of the respective V-RAM planes 21A, 21B, 21C and 21D. Thus, "0" data is written in units of bytes in the respective V-RAM planes 21A, 21B, 21C and 21D; a screen clear is performed.

A timing write operation will now be described. For this purpose, the color element is lighted every other dot on the display screen, and a desired color shading for the color element is obtained by a mixture of the color element lighted on two adjacent dots. Four sets of 2-bit combinations of the write plane data WPD stored in the write plane register 207 are freely set, so that a desired display pattern can be easily written at high speed by tiling. This will be explained with reference to the case of the V-RAM plane 21A. A 2-bit combination of WP0 WP4 selected from the 8-bit write plane data WPD(WP0·WP4, WP1·WP5, WP2·WP6, and WP3·WP7) is set as, for example, WP0="1" and WP4="0". Thus, the bit mask function is rendered ineffective (without masking) so as to perform a write operation in the V-RAM 21.

Then, an 8-bit data pattern supplied to the V-RAM plane 21A is such that the data of the bit positions 0, 2, 4, and 6 supplied to the memory blocks M0, M2, M4 and M6 are set at "1", while the data of the bit positions M1, M3, M5 and M7 supplied to the memory blocks M1, M3, M5 and M7 are set at "0". A dot pattern data representing an R (red) color element is lighted on an alternate dot is written in the V-RAM plane 21A for a red color element. Such an every other dot pattern write operation is performed for desired color element planes or V-RAM planes at the same time. Thus, tiling write with desired color shadings can be performed without complex software processing at high speed.

When a tiling write function as described above is combined with the bit mask function as described above, high-performance color graphic processing can be performed at high speed on the V-RAM 21.

The bit mask data memory, which is used in the first, second and third embodiments described above, to store an item of bit mask data, may be replaced by a memory which can store two or more items of bit mask data. In this case, one of these items is selected by the CPU. Further, the write enable signal, which is used in these embodiments as a writing access signal, may be replaced by a chip enable signal, a RAS signal, a CAS signal or any other signal that can enable or prohibit an access to the memory elements.

Furthermore, the CAS signal, which is used as a plane section signal in the second embodiment, may be replaced by a write enable signal, a chip select signal, a RAS signal or any other signal that can enable and prohibit an access to the memory elements.

What is claimed is:

1. A pattern write control circuit comprising:

memory means, having a plurality of memory planes, for storing color element data, each memory plane storing different color element data respectively to display color dots;

each memory plane including a plurality of memory elements and a plurality of words each having a group of dots in the same location of each memory element, each of said memory elements including one corresponding bit location in each one of said words, respectively, each of said memory elements including address data receiving means for receiving address data designating one of said bit locations within said memory element, and write-in data receiving means for receiving one-bit data to be written in said one of said bit locations;

address data supply means for supplying said address data to all of said memory planes, said address data being received on all of said address data receiving means corresponding to all memory elements of each memory plane so that all said one bit locations of said memory elements designated by said address data collectively form one of said words of each plane;

bit mask writing control means for selecting a selected number of bit locations within each of said one words designated by said address data;

said bit mask writing control means including bit mask data memory means for storing bit mask data which specifies said selected number of bit locations in each of said one words, and means for supplying a write permission signal to said memory elements selected by the bit mask data; and color element data supply means for simultaneously supplying different color element data to the corresponding memory planes respectively, each said color element data being received on the write-in data receiving means of all memory elements of the memory plane corresponding thereto.

2. A circuit according to claim 1, wherein said color element data supply means comprises register means for storing the different color element data to be supplied simultaneously to said memory planes respectively, to thereby write the pattern data into the memory planes.

3. A circuit according to claim 1, wherein said means for supplying the write permission signal includes gate means for supplying said write permission signal to selected memory elements of the planes in synchronism with a writing access signal supplied from an external device.

4. A circuit according to claim 1, wherein said color data supplying means includes a color data register, in which two bit color data pairs, each corresponding to one memory plane and each designating whether a color element is displayed, are stored before the address data are supplied to the memory planes, and one bit of the color data pair is supplied to write-in data receiving means of the memory plane corresponding thereto at intervals of a one bit location, the other bit being supplied to write in receiving means on the remaining bit locations to thereby write tiling dot pattern data into said memory planes.

5. A pattern write control circuit comprising:

memory means, having a plurality of memory planes, for storing different color element data, each memory plane storing different color element data respectively to display color data;

each of said memory planes including address data receiving means for receiving address data designating a word location of the memory plane, and write-in data receiving means for receiving data to be written in said word location;

address data supply means for supplying common address data to all of said memory planes, said common address data being received on said address data receiving means of each memory plane; and color element data supply means for selectivity supplying different word data to respective write-in data receiving means of said memory planes, bits of said word data assigned to each said memory plane designating at least states where (a) a particular color element is displayed, or (b) that an adjacent color element is not displayed.

6. A circuit according to claim 5, wherein said color data supplying means includes a color data register, in which two bit color data pairs, each corresponding to one of the memory planes and each designating whether the color element is to be displayed, are stored before the address data are supplied to the memory planes, one bit of the color pair being supplied to write-in data receiving means of a corresponding memory plane at intervals of a one bit location, the other bit being supplied to write-in data receiving means of a corresponding remaining bit locations, to thereby write a tiling dot pattern data into said memory planes.

7. A circuit according to claim 6, further comprising bit mask writing control means for selecting at least one bit location in a word of each memory plane designated by the address data supplied by said address data supply means.

8. A circuit according to claim 7, wherein each memory plane includes a plurality of memory elements corresponding to different bit locations in a word of the memory plane, each memory plane having a write-in data receiving means for receiving one-bit data to be written in the location designated by the address data, one of each 2-bit color element data being stored in said color element data register and supplied to said write-in data receiving means of memory elements corresponding to alternate bit locations, the other bit of 2-bit color element data being supplied to write-in data receiving means of the remaining memory elements.

9. A circuit according to claim 8, wherein said bit mask writing control means comprises bit mask data memory means for storing bit mask data which selects the bit locations in the word of the memory planes designated by the address data supplied to the memory planes, and means for supplying a writing permission signal to the memory elements which correspond to the bit locations selected by the bit mask data stored in the bit mask data memory.

10. A circuit according to claim 9, wherein said means for supplying a writing permission signal includes gate means for supplying a writing permission signal to said memory elements in response to the bit mask data stored in said bit mask data memory means, in synchronism with a writing access signal supplied from an external device.

11. A circuit according to claim 7, wherein said color data supplying means comprises a color element data register for storing a 2-bit color data pair corresponding to each of said memory planes and selectively designating whether that a color element corresponding to the memory plane is one of displayed, and not displayed.

12. A pattern write control circuit comprising:

memory means, including a plurality of memory planes for storing color elements data, each said memory plane storing different color element data respectively, to display color dots, each of said memory planes including address data receiving means for receiving address data designating a word location of the memory plane and write-in data receiving means for receiving data to be written in the word location;

address data supply means for supplying common address data to all of said memory planes, said common address data being received on the address data receiving means of each memory plane;

color element data supply means for simultaneously supplying different color element data to the write-in data receiving means of said memory planes respectively;

plane selecting means for holding plane selecting data corresponding to each of said memory planes and for selecting one of said memory planes in which pattern data is to be written, in accordance with said plane selecting data; and bit mask writing control means for selecting at least one bit location in said word designated by said address data supplied to said address data supply means.

13. A circuit according to claim 12, wherein said plane selecting means comprises a plane selection data register for storing the plane selecting data before the address data is supplied to the address data receiving means of said memory planes to write pattern data into said selected memory planes, and means for supplying plane selection signals to the memory planes specified by the plane selecting data stored in the plane selection data register when corresponding color element data is written in the selected memory planes.

14. A circuit according to claim 13, wherein said means for supplying the plane selection signal includes gate means for supplying a writing access signal from an external device, as a plane selection signal, to the memory plane specified by the color element data stored in said plane selection data register.

15. A circuit according to claim 12, wherein each memory plane includes a plurality of memory elements corresponding to different bit locations in a word of the memory plane respectively, each of which has address data receiving means for receiving address data designating one location of the memory element and write-in data receiving means for receiving one bit data to be written in the location, and said bit mask writing control means comprises bit mask memory means for storing bit mask data which selects bit locations in a word in a location designated by the address data supplied to a plurality of the memory planes, and means supplying write permission signals to the memory elements which correspond to those bit locations in the word having been specified by the bit mask data stored in the bit mask data memory means.

16. A circuit according to claim 15, wherein said means for supplying a write permission signal includes gate means for supplying a write permission signal to said memory elements selected by the bit mask data stored in said bit mask data memory means, synchronism with a writing access signal supplied from an external device.

* * * * *